US005957716A

United States Patent [19]

Buckley et al.

[11] Patent Number: 5,957,716

[45] Date of Patent: Sep. 28, 1999

[54] LOCKING COUPLING CONNECTOR

[75] Inventors: Paul Philip Buckley, Fernhill Heath; Rex Hall, Pershore; Malcolm Wilfrid Collier, Tewkesbury, all of United Kingdom

[73] Assignee: Ultra Electronics Limited, United Kingdom

[21] Appl. No.: 08/860,308

[22] PCT Filed: Apr. 1, 1996

[86] PCT No.: PCT/GB96/00779

§ 371 Date: Sep. 23, 1997

§ 102(e) Date: Sep. 23, 1997

[87] PCT Pub. No.: WO96/30970

PCT Pub. Date: Oct. 3, 1996

[30] Foreign Application Priority Data

Mar. 31, 1995 [GB] United Kingdom ..... 9506700

[51] Int. Cl.[6] ..... H01R 13/62

[52] U.S. Cl. ..... 439/321

[58] Field of Search ..... 439/321, 320, 439/323, 312, 469, 470, 905

[56] References Cited

U.S. PATENT DOCUMENTS 4,648,671 3/1987 Torban et al. ..... 439/321

5,399,096 3/1995 Quillet et al. ..... 439/321

5,435,760 7/1995 Miklos ..... 439/321

*Primary Examiner*—Steven L. Stephan

*Assistant Examiner*—Eugene G. Byrd

*Attorney, Agent, or Firm*—Reising, Ethington, Barnes, Kisselle, Learman & McCulloch, P.C.

[57] ABSTRACT

A locking coupling comprises a body (1) adapted for connection to a separate body, a coupling collar (2) rotatably mounted on said body (1) and adapted to cooperate with said separate body to hold it in axial connection with said body (1), a locking collar (4) mounted on said body (1) and longitudinally movable thereon between locking and unlocking position, bias means (8) that urges the locking collar (4) towards the locking position, and locking formations (11, 10) on the locking collar (4) and coupling collar (2) that interengage axially when the locking collar (4) is moved to the locking position so as to restrain the coupling collar (2) against rotation on said body (1). The locking collar (4) can be retained in the unlocking position by retention formations (5, 9) on the locking collar (4) and body (1) that interengage longitudinally. The locking collar (4) is held captive longitudinally on the body by The coupling collar, and the latter is held captive on the body by an internal circlip (3). The locking formations (10, 11) comprise axially extending teeth of a saw-tooth form. Warning indicator means on said body (1) is exposed only when the locking collar (4) is in the unlocking position.

8 Claims, 3 Drawing Sheets

LOCKING COUPLING CONNECTOR

This invention relates to a locking coupling, especially vibration resistant locking couplings suitable for use with electrical, pneumatic, hydraulic or optical couplings.

It is common practice to connect multiple electrical conductors together simultaneously with a two-part electrical coupling comprising a pair of electrical connectors in which the conductors terminate and which are pushed together and held together longitudinally by a coupling nut on one connector which engages a thread on the other. A harness assembly in the form of a protective sleeve may cover the conductors and be connected to the electrical connector at one end. It is also known to provide such electrical couplings with a backshell assembly which provides a transition between the conductors usually within a harness assembly, and the electrical connector in which they terminate. A backshell assembly is typically tubular in construction and is attached to the rear of the connector by a coupling nut. The rear end of the backshell assembly may also carry a fitting, such as a coupling nut, for engagement with other components of the harness assembly, such as a cable clamp.

Where electrical couplings and backshell assemblies are subjected to shock or vibration in use, there is the risk that coupling nuts may work loose, and for this reason some form of locking means is sometimes provided to prevent counter-rotation of the coupling nut once it has been tightened up. Many different forms of locking means have been proposed, but these can be complicated to manufacture, assemble and use.

An object of the present invention is to provide a locking coupling with improved locking means.

According to the present invention, a locking coupling comprises a body adapted for connection to a separate body, a coupling collar rotatably mounted on said body and adapted to cooperate with said separate body to hold it in axial connection with said body, a locking collar mounted on said body and longitudinally movable thereon between locking and unlocking position, bias means that urges the locking collar towards the locking position, and locking formations on the locking collar and coupling collar that interengage axially when the locking collar is moved to the locking position so as to restrain the coupling collar against rotation on said body.

Preferably, the locking collar can be retained in the unlocking position by retention formations on the locking collar and body that interengage longitudinally. For example, the retention formations may comprise keying means that guide the locking collar longitudinally on the body and allow rotation of the locking collar on the body only in the unlocking position, when the keying means then cooperate longitudinally to retain the locking collar in the unlocking position.

Preferably, the locking collar is held captive longitudinally on the body by the coupling collar, and the coupling collar in turn is held captive on the body by a separate fastener such as an internal circlip.

Preferably, the locking formations comprise axially extending teeth which may have a saw-tooth form so as to restrain the coupling collar against rotation in one sense which would otherwise allow uncoupling of said separate body. The teeth comprise a long sloping side and a short side which is substantially parallel with the longitudinal axis of the connector. The short side may be undercut (i.e. inclined in the same sense as the long sloping side) to enhance the locking action of the coupling.

An additional preferred feature of the invention comprises indicator means on said body which is covered by the locking collar and only exposed as a warning when the locking collar is in the unlocking position.

The invention will now be described by way of example with reference to the accompanying drawings in which.

The illustrated embodiment comprises a tubular body 1. which may be a backshell adaptor to support a bundle of electrical cables that enter it from the rear and terminate in an electrical connector supported within the front end of the backshell. A coupling nut 2 is rotatably mounted on the front end of the body 1 and is held captive longitudinally thereon by a circlip 3 engaging respective annular grooves in the cooperating surfaces of the nut and body. The nut 2 projects longitudinally beyond the end of the body 1 and is threaded internally for engagement with the aforesaid electrical connector when in use.

Figure 1:
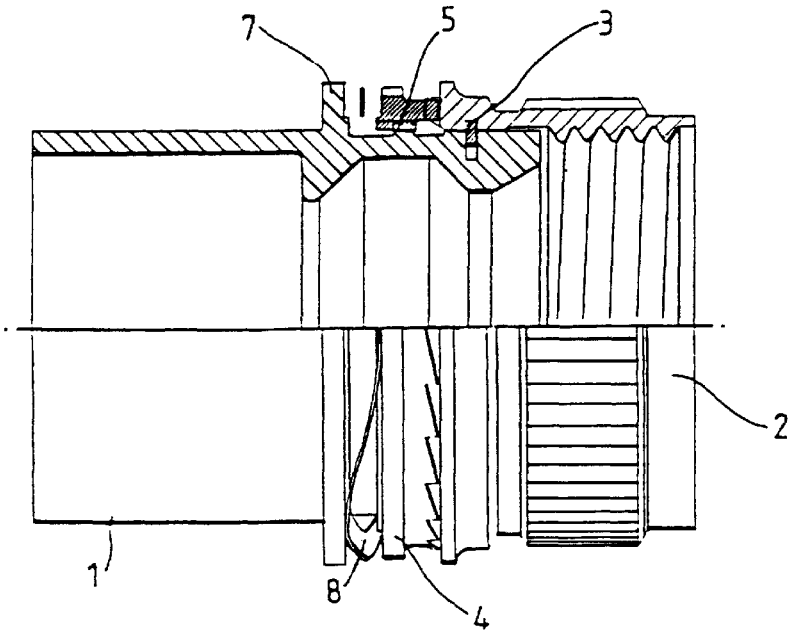
FIG. 1 is a part side elevation and part axial section of a locking coupling according to the invention with the locking collar in the locking position.
Figure 2:
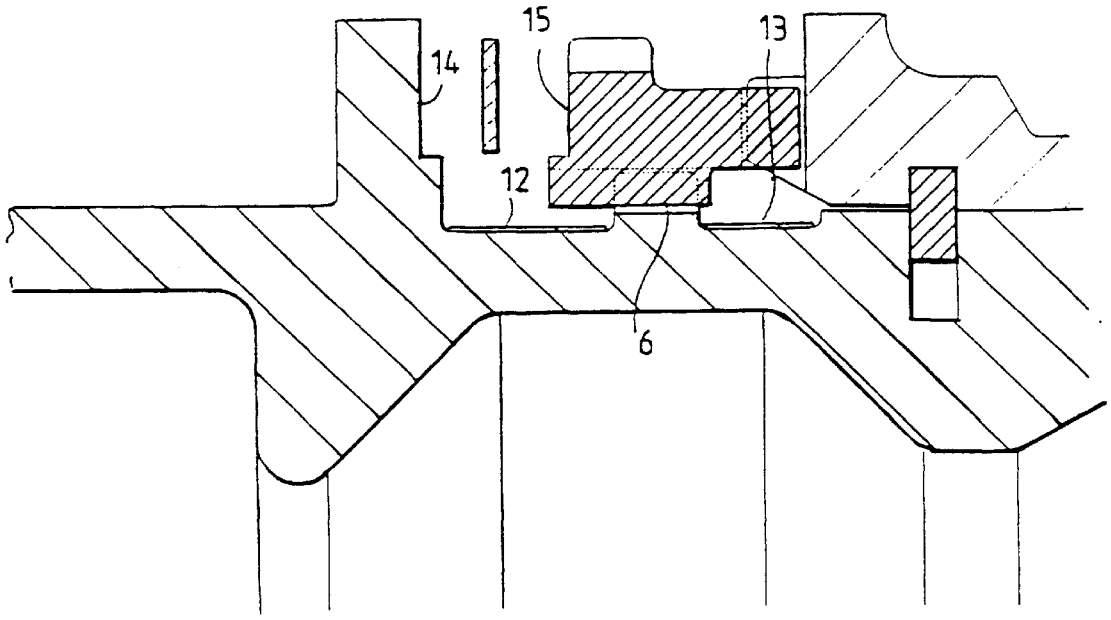
FIG. 2 is an enlargement of part of the drawing of FIG. 1.

Adjacent to the rear of the coupling nut 2, a locking ring or collar 4 is mounted on the body 1, and is formed with a set of inwardly projecting lugs 5 which engage respective longitudinally extending grooves 6 in an annular collar 9 formed on the outer surface of the body so as to guide the locking ring, 4 longitudinally over a short section of its length between the rear face of the nut 2 and an outwardly projecting annular flange 7 around the periphery of the body 1. A spring washer 8 is located between the flange 7 and rear face of the locking ring 4 and acts to urge the latter to a locking position in engagement with the rear face of the coupling nut 2, as shown in FIG. 1.

The rear annular face of the coupling nut 2 is formed with teeth 10 that project longitudinally of the body 1 towards the locking ring 4, and the adjacent annular face of the locking ring 4 is formed with teeth 11 that project longitudinally of the body 1 towards the coupling nut 2 so as to cooperate with the teeth 10 on the latter. These teeth 10 and 11 run in a saw-tooth form around the full annular length of the faces, respective with corresponding alternating inclined and circumferentially abutting edges so that the teeth can ride over one another with a ratchet action when the nut 2 is rotated in one sense to secure an electrical connector to the body 1, and lock together circumferentially to prevent rotation of the nut 2 in the opposite sense that would release said electrical connector. Thus, it is only when the locking ring 4 is moved longitudinally against the action of the spring washer 8 to disengage the teeth 10,11 that the coupling nut 2 can be rotated to release said electrical connector. Furthermore, the arrangement of the teeth 10,11 is such that an interengaging locking action is maintained even if the locking ring 4 is tilted accidentally on the body 1, the teeth 10,11 disengaging on one side of the body, but remaining in engagement on the other of the body.

Figure 3:
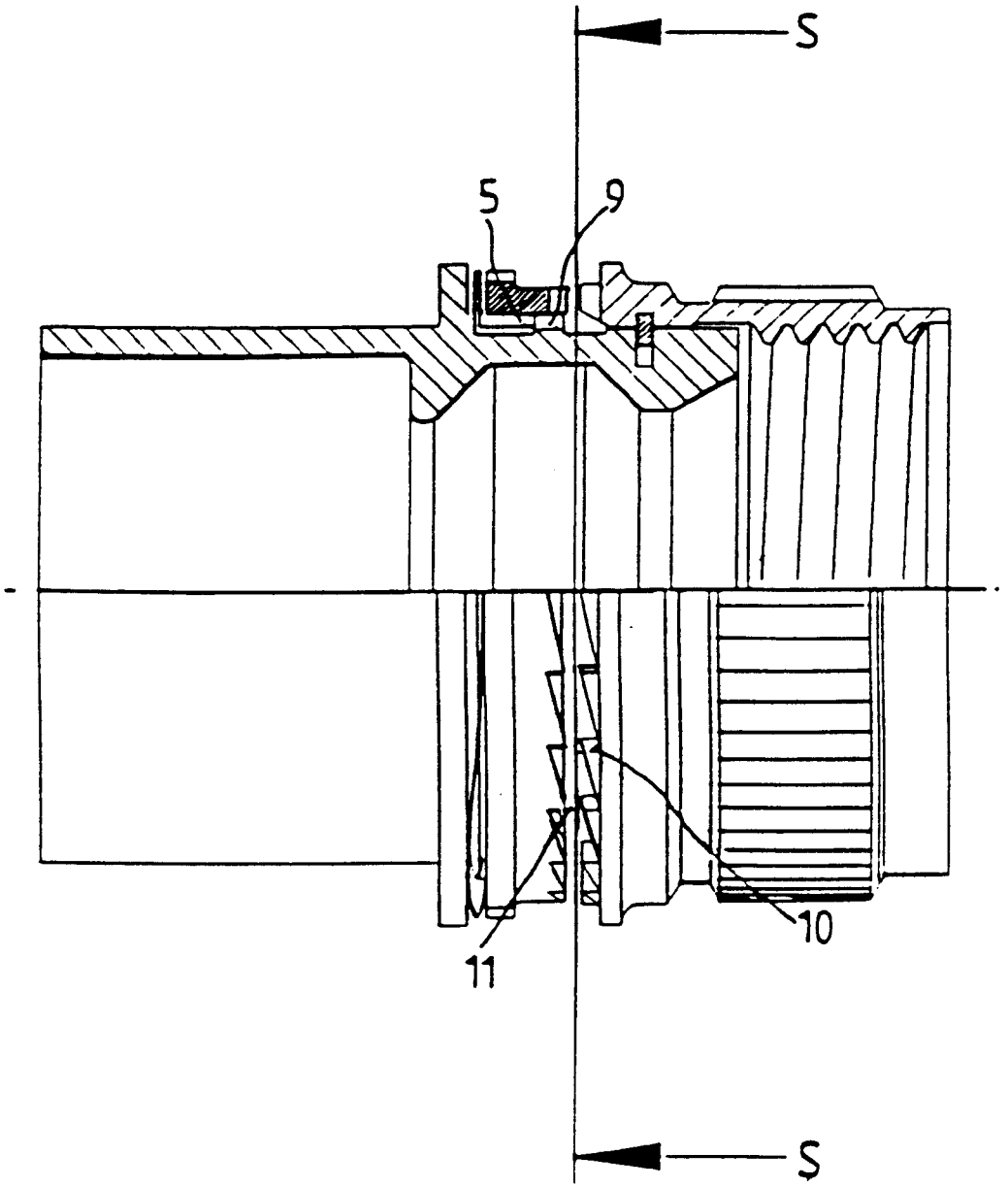
FIG. 3 is a similar view to that of FIG. 1, except that it shows the locking collar in the unlocking position.
Figure 5:
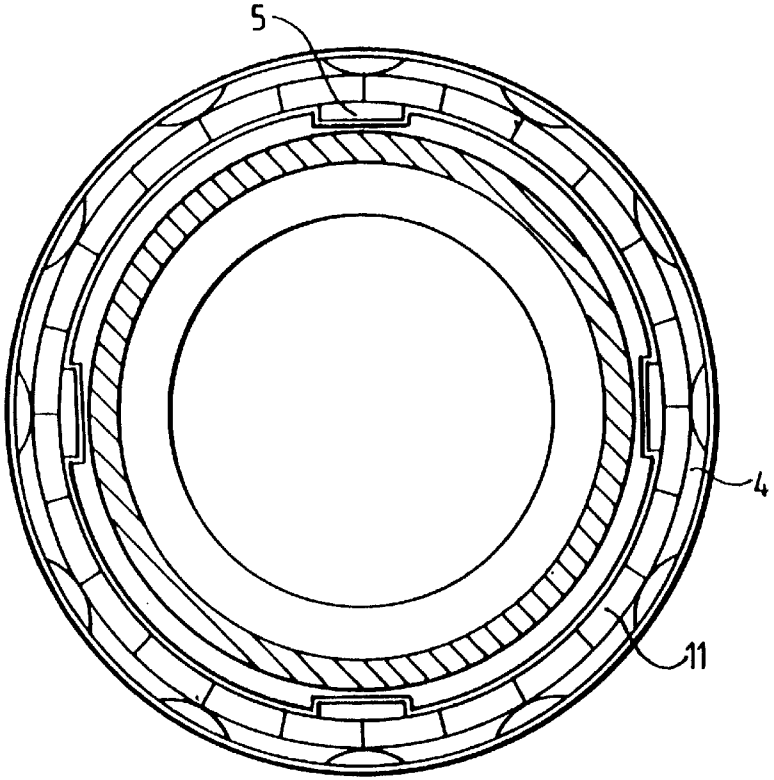
FIG. 5 is a view of the locking collar of the locking coupling of FIG. 3 on the line S—S.
Figure 4:
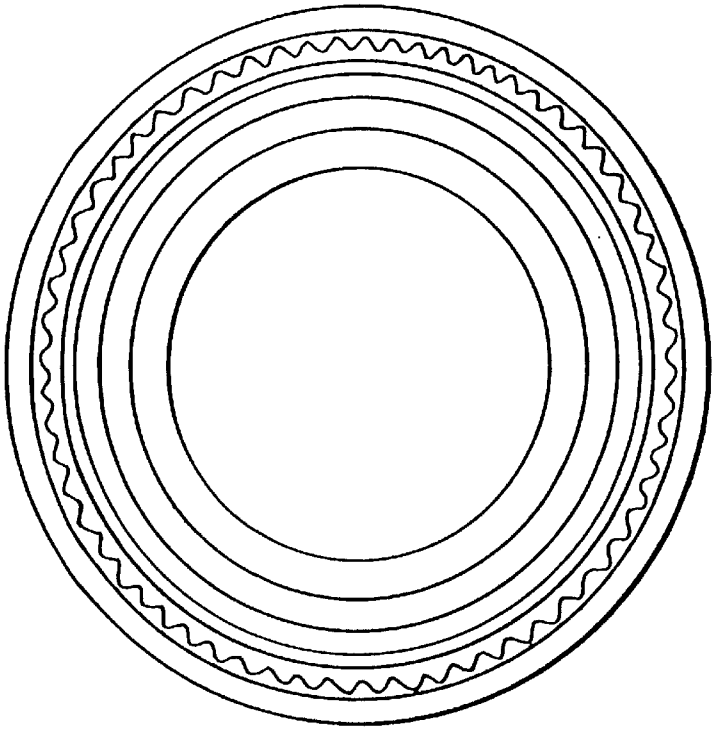
FIG. 4 is an end elevation of the body of the locking coupling of FIG. 1.

In order that the locking ring 4 can be retained in a longitudinal unlocking position spaced away from the coupling nut 2, the inwardly projecting lugs 5 and collar 9 are dimensioned longitudinally so that the lugs 5 disengage the grooves 6 and are located in the annular groove 12 between the flange 7 and collar 9, as shown in FIG. 3, whereupon the ring 4 can be rotated to a position in which the lugs 5 are out of alignment with the grooves 6. The ring 4 can then be released and will be retained longitudinally by engagement of the lugs 5 with the adjacent side wall of the collar 9 through the spring action of the washer 8. Further rotation of the locking ring 4 whilst spring-loaded against the side wall of the collar will release the ring from the unlocking position when the lugs 5 again come into alignment with the grooves 6, the ring 4 then being free to move longitudinally. Annular recesses 14 and 15 are provided in the adjacent faces of the flange 7 and locking ring 4 to accommodate the spring washer 8 when the locking ring is in the unlocking position.

The groove 12 to the rear of the collar 9 is coloured green or blue so as to indicate when the locking ring 4 is in the locking position, and a shallow groove 13 forward of the collar 9 is coloured red so that it is clearly visible when the locking ring is in the unlocking position, and thereby serving as a warning that the coupling nut 2 is not locked.

The outer circumferential surfaces of the coupling nut 2 and locking ring 4 are each textured to assist gripping and rotation, this being especially important in oily environments. Also, the texturing used, whether knurling or ribs, are preferably different in each case to assist tactile differentiation between the two components in question.

The outer diameters of the coupling nut 2 and locking ring 4 are preferably different so as to assist selective operation of one or the other and avoid accidental operation of either member. For example, accidental rotation of the locking ring 4 by a tool engaging the coupling nut 2 could damage the lugs 5 of the former so that it is no longer effective. This can be avoided by making the locking ring 4 of smaller diameter than the coupling nut 2, as shown in the drawings, but equally the locking ring 4 could be made significantly larger in diameter to avoid the same problem.

In some applications, a special tool might be provided to operate the locking ring.

The number of teeth can be freely chosen to select the amount of rotation that separates each locking position. It has been found that a resolution of 10° or so between each locking position maintains good electrical connection between the opposing parts of the coupling. This requires the provision of 30 or more teeth on the nut and locking ring.

Drain holes may be provided in the region of the spring washer 8 to allow the escape of moisture due to condensation.

In a further arrangement the short faces of the teeth may be inclined with respect to the longitudinal axis of the connector by between substantially 0 and 5° in an undercut manner to further enhance the resistance of the locking ring to unintentional disengagement due to extreme vibration.

We claim:

1. A locking coupling comprising: a body (1) adapted for connection to a separate body; a coupling collar (2) rotatably mounted on said body and adapted to cooperate with said separate body to hold it in axial connection with said body, said coupling collar being rotatable in a locking sense to hold said body (1) and said separate body together, and in a release sense to release said body from said separate body; a locking collar mounted on said body and longitudinally movable with respect to the coupling collar between locking and unlocking positions; bias means (8) that urge the locking collar (4) towards the locking position; and locking formations (10, 11) on the locking collar and coupling collar; characterised in that the locking collar (4) is restrained from rotating when it is at the locking position and in that the locking formations on the coupling collar interengage axially with those on the locking collar when the locking collar is moved to the locking position so as to restrain the coupling collar against rotation in the release sense on said body (1).

2. A locking coupling as claimed in claim 1 in which the locking collar (2) is retained in the unlocking position by retention formations (5,9) on the locking collar and body that interengage longitudinally.

3. A locking coupling as claimed in claim 2 in which the retention formations comprise keying means that guide the locking collar longitudinally on the body and allow rotation of the locking collar on the body only in the unlocking position, when the keying means then cooperate longitudinally to retain the locking collar in the unlocking position.

4. A locking coupling as claimed in any one of the preceding claims in which the locking collar (4) is held captive longitudinally on the body by the coupling collar (2), and the coupling collar in turn is held captive on the body by a separate fastener (3).

5. A locking coupling as claimed in claim 4 in which the separate fastener (3) comprises an internal circlip.

6. A locking coupling as claimed in any one of the preceding claims in which the locking formations comprise axially extending teeth (10,11).

7. A locking coupling as claimed in claim 6 in which the teeth have a tooth form so as to restrain the coupling collar against rotation in one sense which would otherwise allow uncoupling of said separate body.

8. A locking coupling as claimed in any one of the preceding claims in which indicator means on said body is covered by the locking collar and only exposed as a warning when the locking collar is in the unlocking position.

* * * * *